US008282711B2

(12) United States Patent
Grenstad et al.

(10) Patent No.: US 8,282,711 B2
(45) Date of Patent: Oct. 9, 2012

(54) SUBSEA INSTALLATION AND METHOD FOR SEPARATION OF LIQUID AND GAS

(75) Inventors: Jens Grenstad, Mjøndalen (NO); Marit Mork, Kongsberg (NO); Odd Marius Rosvold, Jar (NO); Magnus Bernt, Oslo (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 285 days.

(21) Appl. No.: 12/450,296

(22) PCT Filed: Mar. 18, 2008

(86) PCT No.: PCT/NO2008/000109

§ 371 (c)(1),
(2), (4) Date: Mar. 4, 2010

(87) PCT Pub. No.: WO2008/115074

PCT Pub. Date: Sep. 25, 2008

(65) Prior Publication Data

US 2010/0180769 A1 Jul. 22, 2010

(30) Foreign Application Priority Data

Mar. 20, 2007 (NO) ..... 20071489

(51) Int. Cl.
*B01D 19/00* (2006.01)

(52) U.S. Cl. ..... 95/253; 95/260; 96/182; 96/204; 166/357

(58) Field of Classification Search ..... 95/253, 95/260; 96/182, 204; 166/357; 210/537
See application file for complete search history.

(56) References Cited

U.S. PATENT DOCUMENTS

| | | | | |
|---|---|---|---|---|
| 1,559,115 | A * | 10/1925 | Marker et al. | 96/184 |
| 3,880,102 | A | 4/1975 | Biewer | |
| 4,661,127 | A | 4/1987 | Huntley | |
| 6,277,286 | B1 | 8/2001 | Søntvedt et al. | |
| 6,468,335 | B1 | 10/2002 | Polderman | |
| 7,540,902 | B2 * | 6/2009 | Esparza et al. | 95/243 |
| 7,611,635 | B2 * | 11/2009 | Chieng et al. | 210/744 |
| 8,002,121 | B2 * | 8/2011 | Berard et al. | 210/533 |
| 2006/0151167 | A1 | 7/2006 | Aarvik et al. | |
| 2006/0162553 | A1 * | 7/2006 | Esparza et al. | 95/43 |

FOREIGN PATENT DOCUMENTS

| | | | |
|---|---|---|---|
| GB | 2 369 787 | A | 6/2002 |
| NO | 316840 | B1 | 5/2004 |
| WO | WO 03/033872 | A1 | 4/2003 |
| WO | WO 2006/098637 | A1 | 9/2006 |
| WO | WO 2006/118468 | A1 | 11/2006 |

* cited by examiner

*Primary Examiner* — Duane Smith
*Assistant Examiner* — Douglas Theisen

(57) ABSTRACT

The present invention relates to a subsea installation for treatment of hydrocarbons from a subsea well, having a pipe system comprising a first manifold (2) connected to at least one well (1) and at least two first pipe segments (3) with an inlet connected to the manifold (2) and where the first pipe segments (3) comprise at least two outlets, where the first manifold (2) and the first pipe segments (3) are arranged in a first plane and where one of the outlets from the first pipe segments leads to a second manifold (7). According to the invention a second of the outlets from the first pipe segments (3) leads to at least two second pipe segments (9) arranged in a second plane and where at least one of the outlets forms an inlet to the second pipe segments (9), where the second pipe segments (9) comprise at least one outlet leading to a third manifold (12).

12 Claims, 1 Drawing Sheet

SUBSEA INSTALLATION AND METHOD FOR SEPARATION OF LIQUID AND GAS

BACKGROUND OF THE INVENTION

The present invention relates to a subsea installation for, for example, separation of hydrocarbons from a subsea well. The invention also relates to a method for separating liquid from gas from a subsea well stream by means of gravitational forces.

Reservoirs from which hydrocarbons are produced may be roughly divided into two types:

1. Gas/condensate reservoirs
2. Oil reservoirs

The well stream from a gas/condensate reservoir will mostly contain natural gas, but will also contain condensates (light hydrocarbons in liquid phase). In addition it may contain water, either in the form of condensed water which is in equilibrium with the gas under existing pressure and temperature, or produced water from the reservoir. There may, moreover, be chemicals added at the wellhead in order to avoid corrosion and gas hydrates.

The well stream from an oil reservoir mostly contains oil, but there will normally be a varying fraction of natural gas. In addition this well stream may also contain water and added chemicals such as corrosion inhibitors, scale inhibitors, etc.

Whether it is produced water or condensed water, the water is not a commercially exploitable resource in the well stream and may cause problems such as increased pressure loss, slugs, corrosion, scaling, emulsions and hydrates in the transport system.

When hydrocarbons are recovered from a subsea well, the existing reservoir pressure is used to transport the liquid and gas mixture from the reservoir up to the wellhead and through the transport pipeline to a receiver terminal or to a floating production unit (FPSU—Floating Production Surface Unit).

The part of the transport line that extends on the seabed will have natural undulations and the liquid fraction of the well stream will collect at the lowest points when the well stream velocity is sufficiently low. When sufficient liquid has collected, a slug may be formed which is driven by a high back pressure and pushed through the pipeline system. This slug is an undesirable event in a multiphase transport system and may lead to problems for the receiving system in the form of rapid pressure changes and the risk of liquid in undesirable parts of the receiving system. Where the slug reaches an onshore installation, large mechanical constructions (slug catchers) have to be built for damping these pressure changes and storing of the incoming volume of liquid. The drawback with this solution is that it requires a great deal of space.

During production to an FPSU, particularly when the unit is located in a deep-water maritime area, the slug will induce stress on the riser system, in addition to which the liquid column will increase the counter-pressure on the reservoir, thereby creating rapid pressure and volume flow changes which are difficult to handle on the floating unit. This problem is normally remedied by injecting gas into the bottom of the riser, thereby helping to lift the slug up through the riser. The disadvantage of this solution is that the pressure loss in the riser will be high on account of increased friction.

Another solution is to install one or more separator tanks on the seabed, where the gas fraction is separated from the liquid, and the liquid and the gas are passed up to the surface in separate risers. The liquid then has to be pumped up to a higher pressure. The disadvantage of this solution is the size of the separator tank which must have a large diameter in order to provide good separation. On account of high external or internal pressure, it is necessary to have thick-walled tanks, which makes them difficult to produce with today's technology. In addition the separator tanks often have complex insides requiring maintenance, which in turn means that they must be capable of being pulled up to the surface. This is time-consuming and costly. From the design point of view this means that the separator tanks on the seabed must consist of several mechanical constructions which can be connected by means of a remotely controlled installation system. If the device is installed in an area where fishing is conducted, the installation must also be capable of being trawled over, thereby also increasing the size and weight of the equipment.

SUMMARY OF THE INVENTION

Instead of large diameter separator tanks, it is proposed to design this as a long pipe laid horizontally or slightly sloping on the seabed. Examples of such solutions are disclosed, for example, in NO 19994244 and NO 20015048. The drawback with this solution is that it can only be used on gas reservoirs where the liquid fraction is low. The present invention can be used on both types of reservoir regardless of the liquid/gas ratio in order to separate the liquid from the gas and the different liquid phases from one another, before transporting them in different pipelines to shore or platforms. The present invention may also be employed for re-injecting produced and condensed water into the reservoir in order to help to maintain the reservoir pressure.

By separating gas and liquid and introducing separate transport, the degree of recovery for the reservoir can be increased and problems in the transport system prevented.

With the invention, equipment is provided for placing on the seabed which is simple, can function autonomously and separate liquid from gas. In addition the liquid can be separated into a hydrocarbon fluid phase and a water phase where the water can be re-injected or transported separately.

Where the well stream comes from a gas/condensate reservoir, an arrangement of this kind can be installed in a location where the temperature of the well stream has been cooled to the seabed temperature, with the result that all saturation water has been precipitated. The liquid (condensate, glycol and condensed water) can be separated and pumped in separate pipelines to shore. The remaining gas flows to shore by itself. The result is that very little liquid collects in the transport line to shore or platform, thereby eliminating the need for large slug catchers at the receiving point.

The object of the present invention is to provide a subsea installation which will act as a buffer system in connection with a pump and/or act as a system for dissolving potential slugs which may be formed in connection with recovery of a petroleum well and/or act as a separator for at least two phases of a well stream; such as oil-gas, oil-gas-water, oil-water. A second object of the invention is to provide a system which separates liquid from gas in a more efficient manner by equalizing the flow before it enters the part of the system where the actual separation is conducted. This is achieved by the inlet being connected to a manifold connected to at least one well, the said manifold being designed to remove slugs from the well stream. A further object is to provide a subsea system which is cost-effective and easy to adapt to the special conditions in which it is to be employed.

These objects are achieved with a subsea installation for treatment of hydrocarbons from a subsea well and a method according to the attached claims.

A subsea installation is provided for treatment of hydrocarbons from a subsea well, having a pipe system comprising a first manifold connected to at least one well and at least two first pipe segments with an inlet connected to the manifold. The manifold may have one or more inlets from one or more wells and these may be arranged at the middle of the pipe, grouped, distributed over the length of the pipe or at the ends of the pipe, advantageously distributed uniformly outwards from the middle of the pipe. The inlet from a well may be arranged perpendicularly to a longitudinal axis for the manifold, or given another angle. If there are several inlet pipes to the manifold, these may have the same or different angles. The at least two first pipe segments have inlets conveying the fluid from the manifold into the at least two first pipe segments. Furthermore, the first pipe segments comprise at least two outlets, and each of the first pipe segments will preferably have at least two outlets. The first manifold and the first pipe segments are arranged in a first plane. By arranged in a first plane it should be understood that a longitudinal axis for the manifold and a longitudinal axis for the pipe segments lie in a common plane. One of the outlets from the first pipe segments leads to a second manifold.

According to the invention the arrangement involves a second of the outlets from the first pipe segments leading to at least two second pipe segments arranged in a second plane. At least one of the outlets from the first pipe segments forms an inlet to the second pipe segments. The second pipe segments also comprise at least one outlet leading to a third manifold.

According to one aspect of the invention the first plane with the first pipe segments and the second plane with the second pipe segments may be substantially parallel planes. However, it is also conceivable for the planes to be formed at an angle to each other.

According to another aspect the pipe segments in at least one plane may be arranged with their longitudinal axes substantially parallel. In an alternative variant, longitudinal axes of the pipe segments may be arranged to form a fan shape in one plane. A possible configuration of this kind is, for example, where the first manifold is in the form of a circular arc, where the longitudinal axes of the pipe segments can extend in such a fashion that they approach each other or increase in distance from each other in the direction away from the first manifold. A further alternative is also to lay the pipe segments winding in the plane.

According to another aspect, at least one of the outlets from the second pipe segment may form the inlet to at least two third pipe segments. These third pipe segments may be arranged in a third plane where at least one outlet from the third pipe segment leads to a fourth manifold. The installation may, of course, also be extended in further stages if so desired.

According to an aspect at least one of the manifolds may have a longitudinal axis substantially perpendicular to a longitudinal axis of the pipe segments.

According to another aspect at least one of the outlets from the first pipe segments may be at an oblique angle relative to a longitudinal axis of the first pipe segments. This obliquely-oriented outlet may also extend out of the plane for the first pipe segments. In a possible variant all the outlets from the first pipe segments may lead out of the plane for the first pipe segments. In a possible variant one of the outlets may be arranged perpendicularly to the plane. In a possible alternative variant one of the outlets may be located in the plane and lead to a manifold in the plane.

According to another aspect the first plane may be a substantially horizontal plane with the second plane located vertically below the first plane. By substantially horizontal it should also be understood that it may be at a small angle relative to the horizontal plane. In a possible variant a first plane is substantially horizontal or slightly sloping while an underlying plane may form a more sloping plane than the first plane. Alternatively, the planes may be substantially parallel.

According to an aspect of the invention the first pipe segments may be tubular separators and a first outlet may be a gas outlet. This gas outlet may extend relatively upwards from the first plane, or alternatively be arranged in the same plane. A second outlet from the first pipe segments may be a liquid outlet leading relatively downwards to the second pipe segments. In a possible variant the second pipe segments may comprise an outlet in the form of a gas outlet leading to the second manifold or to the first pipe segments downstream of the liquid outlet from these pipe segments. In a variant the third manifold may lead to a first pumping station. According to an aspect of the invention the subsea installation will comprise two or more planes with pipe segments, depending on whether one wishes to separate gas from liquid, two liquids or gas, oil and water from one another.

The invention also relates to a method for separation of liquid and gas and possibly also separation of liquid in hydrocarbon fluid and water. The method comprises firstly transporting a well stream to a slug buffer mounted on the seabed, then transporting the well stream to a gravitation separation system, where liquid and gas are separated by distributing the well stream in a given number of pipe segments arranged in several planes, whereby the gas is led in one plane and the liquid in one or more second planes, whereupon the gas and liquid are transported onwards in their own separate transport systems. The slug buffer is the arrangement of the manifold where the fluid has only just long enough residence time for any slugs to be dissolved.

According to an aspect the gas may be conveyed through an additional device for removal of residual water which the gravitation part of the system failed to remove.

According to the invention the installation or the system is preferably arranged in such a manner that the parts are disposed in several planes. Separated liquid can thereby flow out by means of gravity. A more compact structure is also achieved.

The arrangement may also be configured so as to enable the liquid to be separated into a hydrocarbon phase and a water-based phase. The water-based phase can be pumped to the platform, to shore or down into an underground reservoir.

The invention involves a number of advantages; the arrangement can be employed for all types of well streams from all types of reservoirs, it is designed and installed in both deep and shallow water, it performs gravitational separation and is designed according to pipe codes instead of tank codes, which will give savings both with regard to cost and weight. Pipe codes and tank codes are concerned with standards and rules for building things which have to withstand pressure and the fact that the standards are different for the same pressure class, for example the wall thickness requirement for a tank is much greater than for a pipe. Another advantage is that a pipe system can be assembled from standard segments which can be bought, while a tank has to be designed and tested in each individual case. Furthermore, the installation according to the invention can be set up in combination with a HIPPS system, be self-supporting during lifting and installation as it does not need a separate structure in order to support the load of the pipes and it can be installed in areas where trawler fishing takes place since the pipe guides can be designed so as to make it possible to trawl over the installation.

The method according to the invention involves the steps of transporting the well stream to a combined gravitation separation system and slug buffer with an additional device for liquid separation mounted on the seabed, and separating liquid and gas by distributing the well stream in a given number of pipes on several planes. The gas is conveyed in one plane and the liquid in one or more second planes and the gas is transported onwards in a separate transport system. The liquid is pumped and transported onwards in a separate transport system.

BRIEF DESCRIPTION OF THE DRAWINGS

The invention will now be described in greater detail with reference to the accompanying figures, in which.

DETAILED DESCRIPTION OF THE INVENTION

Figure 1:
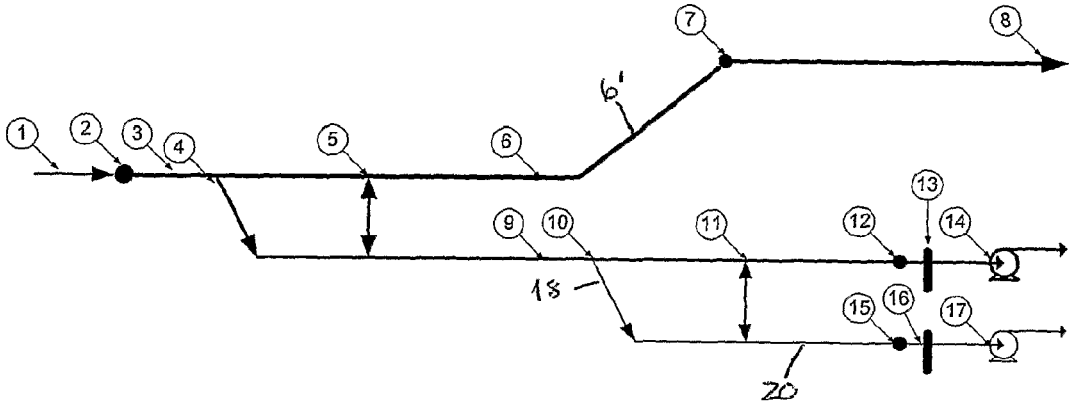
FIG. 1 is a schematic drawing of an installation on the seabed viewed from the side.
Figure 2:
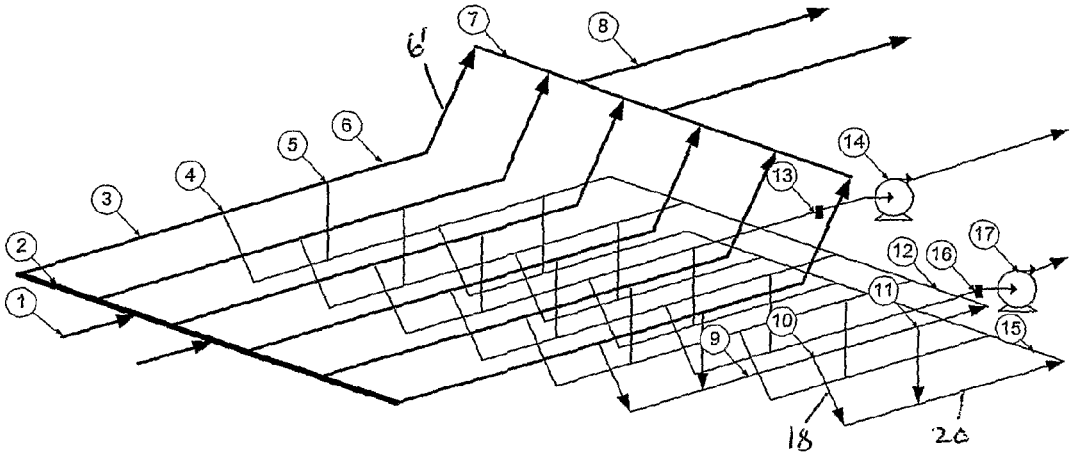
FIG. 2 is an isoschematic drawing of an installation on the seabed.

FIGS. 1 and 2 illustrate a number of flowlines 1. Each flowline comes from a single subsea production system, which may be a satellite well or a group of wells arranged on manifolds (not shown). For example, in the figures two flowlines are illustrated. The number of wells which are required to be connected to the installation is determined by the total production and the capacity of the installation and may vary from a single well to all the wells from a whole field.

The flowlines are passed to a collecting pipe or manifold 2. In the preferred embodiment, the manifold 2 is depicted in the figures arranged perpendicularly to the flowlines, but other configurations are also possible, such as at an angle. The connecting points for the flowlines 1 are distributed symmetrically along the manifold 2 in such a manner that a good distribution of the well stream is obtained in the manifold.

The task of the manifold is to remove or equalize slugs located in the well stream. The manifold 2 has an internal diameter and length which must be adapted to the composition and flow rate of the well streams concerned, thus enabling the incoming slugs to be distributed quickly enough.

A number of first pipe segments 3 which are advantageously arranged at fixed intervals are each connected to the manifold 2. The pipe segments 3, which act as separator pipes, are arranged in the same plane as the manifold 2 and preferably perpendicular to the manifold. Each separator pipe 3 comprises a first part 6 extending horizontally or slightly downwardly and a second part or outlet 6' which slopes upwards from the first part. The separator pipes 3 are designed to separate gas and liquid flowing through the pipes and are of such a diameter and length that the liquid and the gas are separated efficiently. This is accomplished by calculating the necessary number and diameter of the separator pipes 3 and the length of the part 6 together with the height and angle of the outlet 6'. The sum of the separator pipes' capacity corresponds to the incoming flow rate from the wells.

A second manifold 7 is connected to the other end of the pipe segments 3 and preferably arranged perpendicularly thereto. The manifold 7 collects the gas from the separator pipes into one flow, which it leads into a gas transport pipe 8 constituting a gas transport system for conveying the gas to a floating production unit or to shore.

Each separator pipe 3 has an outlet 4 for separated liquid. The outlet 4 is intended to receive the liquid which is separated in the separator pipes 3. The outlets 4 are arranged at such a distance from the manifold 2 that the gas and the liquid have separated. This means that the liquid and the gas flow in a stratified fashion through the pipe with the liquid at the bottom. The outlets 4 are arranged as downwardly sloping down pipes carrying the liquid down to a lower level. The outlets or the down pipes 4 are arranged so that most or all of the liquid will flow down the down pipe on account of gravity. The number of down pipes and the down pipes' distance from the manifold 2 are adapted to the well stream's physical characteristics in order to optimise the efficiency of the separation.

Additional outlets 5 may, if necessary, be connected to the pipe segments 3 and are intended for any additional liquid which has been separated after the first outlet 4. The outlets 5 can also act to ensure that any as which has been separated from the liquid downstream of the outlets 4 can be passed back up to the first pipe segments 3.

Each outlet 4 and 5 is connected to a corresponding second pipe segment or liquid outlet pipe 9. The second pipe segments 9 are arranged in a second plane which is advantageously located below the first plane. The liquid outlet pipes 9 are designed to be large enough for interim storage of slugs from the pipelines leading to the installation.

The liquid outlet pipes 9 are connected to a manifold 12 which in turn is connected to a transport pipe. A pump 14 may be mounted in the transport pipe in order to increase the pressure in the liquid (if necessary) before it is passed into a separate liquid transport system to shore or to platform.

If the well stream contains solid particles (for example sand), these will flow along with the liquid and may be collected in a sand removal device 13. In this event, the sand removal device 13 will be located upstream of the liquid pump 14.

In many cases the well stream will contain some water. If so, the water will accompany the liquid phase which is separated in the separator pipes 3. If it is also desirable to separate the water from the oil fraction, the installation may be provided with an additional pipe system 18. In this case the pipe system 18 will be located in a third plane which is arranged below the second plane. In the same way as described above, each liquid outlet pipe 9 may have an outlet or down pipe 10 and 11 for water. The water runs along the down pipe 10 to a set of third pipe segments or water outlet pipes 20 which are connected to an additional manifold 15. As described earlier, the number of outlets 20 and the distance of the outlets from the liquid down pipes 4 and 5 must be adapted to the well stream's physical characteristics in order to optimize the efficiency of the operation.

The manifold 15 for water is connected to a transport pipe. A pump 17 is placed in the transport pipe for pumping the water to shore or for injecting in a formation under the seabed. If the well stream contains particles (sand), these will be carried along with the water fraction. The sand removal device 16 will then be located here. In this case it will be located upstream of the liquid pump 17.

The device will advantageously be constructed so as to constitute a self-supporting structure designed to withstand the loads to which the device is exposed during lifting and installation on the seabed. In addition, the pipes may be laid in such a manner that the device can be trawled over.

The invention has now been explained with reference to an embodiment, but a person skilled in the art will appreciate that modifications and changes may be made to this embodiment which are within the scope of the invention as defined in the following claims.

The invention claimed is:

1. A subsea installation for separation of hydrocarbons from a subsea well, the installation comprising:

a first manifold which is connected to at least one well;

at least two first pipe segments which are each connected to the first manifold, the first manifold and the first pipe segments being arranged in a first plane;

at least two second pipe segments which are arranged in a second plane located below the first plane;

each first pipe segment comprising a first outlet which is connected to a second manifold and a second outlet which is connected to a corresponding second pipe segment;

each second pipe segment comprising an upstream-most inlet which is connected to a second outlet of a corresponding first pipe segment and at least one third outlet which is connected to a third manifold;

wherein the longitudinal axis of the first manifold is substantially perpendicular to the longitudinal axes of the first pipe segments and the first pipe segments are arranged with their longitudinal axes substantially parallel.

2. A subsea installation as claimed in claim 1, wherein the first plane and the second plane are substantially parallel.

3. A subsea installation as claimed in claim 1, wherein the first and second pipe segments are arranged with their longitudinal axes substantially parallel.

4. A subsea installation as claimed in claim 1, further comprising:

at least two third pipe segments which are arranged in a third plane located below the second plane;

each second pipe segment comprising a fourth outlet which is connected to a corresponding third pipe segment; and each third pipe segment comprising a fifth outlet which is connected to a fourth manifold.

5. A subsea installation as claimed in claim 4, wherein the longitudinal axes of at least two of the first through fourth manifolds are substantially perpendicular to the longitudinal axes of the first and second pipe segments.

6. A subsea installation as claimed in claim 1, wherein at least one of the first and second outlets of each first pipe segment forms an oblique angle relative to the longitudinal axis of the first pipe segments and extends out of the first plane of the first pipe segments.

7. A subsea installation as claimed in claim 1, wherein the first plane is a substantially horizontal plane and the second plane is located vertically below the first plane.

8. A subsea installation as claimed in claim 7, wherein the first pipe segments comprise tubular separators, the first outlet comprises a gas outlet which extends relatively upwards from the first plane and the second outlet comprises a liquid outlet which extends relatively downwards to the second pipe segments.

9. A subsea installation as claimed in claim 8, wherein each of the second pipe segments comprises a sixth outlet which is connected to a corresponding first pipe segment downstream of the second outlet.

10. A subsea installation as claimed in claim 1, wherein the third manifold is connected to a first pumping station.

11. A method for separation of liquid and gas which comprises:

conveying a well stream to a slug buffer mounted on the seabed, conveying the well stream from the slug buffer to a gravitation separation system as defined in claim 1, separating the liquid and gas by distributing the well stream through a number of pipes which are located in several planes, thereby causing the gas to be led in one plane and the liquid to be led in one or more second planes, and transporting the gas and the liquid through respective transport systems.

12. A method as claimed in claim 11, wherein the gas is led through an additional device for removal of residual water.

* * * * *